US008450626B2

(12) United States Patent
Yang

(10) Patent No.: US 8,450,626 B2
(45) Date of Patent: May 28, 2013

(54) PRESS KEY

(75) Inventor: Liang-Yuan Yang, Keelung (TW)

(73) Assignee: Changshu Sunrex Technology Co., Ltd. (CN)

( * ) Notice: Subject to any disclaimer, the term of this patent is extended or adjusted under 35 U.S.C. 154(b) by 184 days.

(21) Appl. No.: 13/151,061

(22) Filed: Jun. 1, 2011

(65) Prior Publication Data

US 2012/0305376 A1 Dec. 6, 2012

(51) Int. Cl.
*H01H 13/70* (2006.01)

(52) U.S. Cl.
USPC ..... 200/344

(58) Field of Classification Search
USPC ..... 200/344, 5 A, 310–314, 341, 345, 200/340, 510–515, 517, 302.1, 302.2, 293
See application file for complete search history.

(56) References Cited

U.S. PATENT DOCUMENTS

| | | | | |
|---|---|---|---|---|
| 5,172,805 | A * | 12/1992 | Gumb | 200/341 |
| 5,386,091 | A * | 1/1995 | Clancy | 200/517 |
| 6,239,391 | B1 * | 5/2001 | Nishijima et al. | 200/5 A |
| 6,252,184 | B1 * | 6/2001 | Tsai et al. | 200/5 A |
| 6,288,353 | B1 * | 9/2001 | Chiang | 200/512 |
| 7,714,245 | B2 * | 5/2010 | Chi | 200/344 |
| 2012/0018289 | A1 * | 1/2012 | Hwa | 200/5 A |

* cited by examiner

*Primary Examiner* — Edwin A. Leon
(74) *Attorney, Agent, or Firm* — Brinks Hofer Gilson & Lione

(57) ABSTRACT

A press key includes: a circuit module; a keycap disposed above the circuit module; and an elastic member disposed between the circuit module and the keycap, and including a bowl portion and a leg portion. The bowl portion has a width larger than that of the leg portion and includes a top open end facing the keycap, a bottom wall opposite to the top open end, a first contact extending upwardly from the bottom wall to contact the keycap when the keycap is pressed, and a second contact extending downwardly from the bottom wall to contact the circuit module when the keycap is pressed. The leg portion extends downwardly from the bottom wall and surrounds the second contact.

7 Claims, 4 Drawing Sheets

PRESS KEY

BACKGROUND OF THE INVENTION

1. Field of the Invention

This invention relates to a press key, more particularly to a press key that can be smoothly operated.

2. Description of the Related Art

Referring to FIG. 1, a conventional press key 9 includes a circuit module 90, a keycap 96, and a scissors type-linkage assembly (not shown) disposed between the circuit module 90 and the keycap 95. The circuit module 90 has a substrate 91, a flexible circuit board 92, and an insulating film 93. The insulating film 93 has an elastic element 8 thereon.

The elastic element 8 has an inverted bowl portion 81 and a leg portion 82. The leg portion 82 is disposed to face a bottom side of the keycap 96. The inverted bowl portion 81 has a bottom open end 810 disposed to face the flexible circuit board 92, and a contact 811 protruding downwardly from a top side of the inverted bowl portion 81. When the press key 9 is not in use, the contact 811 is spaced apart from the flexible circuit board 92.

Referring to FIG. 2, when the keycap 96 of the press key 9 is pressed, the contact 811 of the elastic member 8 is moved to contact the flexible circuit board 92 and to generate a keying signal. When the press key 9 is released, the keycap 96 is returned to an original position as shown in FIG. 1 by a restoring force of the elastic member 8.

The elastic member 8 in the conventional press key 9 is formed in an inverted bowl structure, which is large at the bottom open end 810 and small at a top end thereof. When the press key 9 is pressed, because the key cap 96 is supported by the small top end of the elastic member 8, the force applied to the keycap 96 may be uneven. Therefore, operation of the press key 9 may not be smooth.

SUMMARY OF THE INVENTION

Therefore, an object of the present invention is to provide a press key that can overcome the aforesaid drawback associated with the prior art.

Accordingly, a press key of this invention comprises:

a circuit module;

a keycap disposed above the circuit module; and an elastic member disposed between the circuit module and the keycap, and including a bowl portion and a leg portion, the bowl portion having a width larger than that of the leg portion and including a top open end facing the keycap, a bottom wall opposite to the top open end, a first contact extending upwardly from the bottom wall to contact the keycap when the keycap is pressed, and a second contact extending downwardly from the bottom wall to contact the circuit module when the keycap is pressed, the leg portion extending downwardly from the bottom wall and surrounding the second contact.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
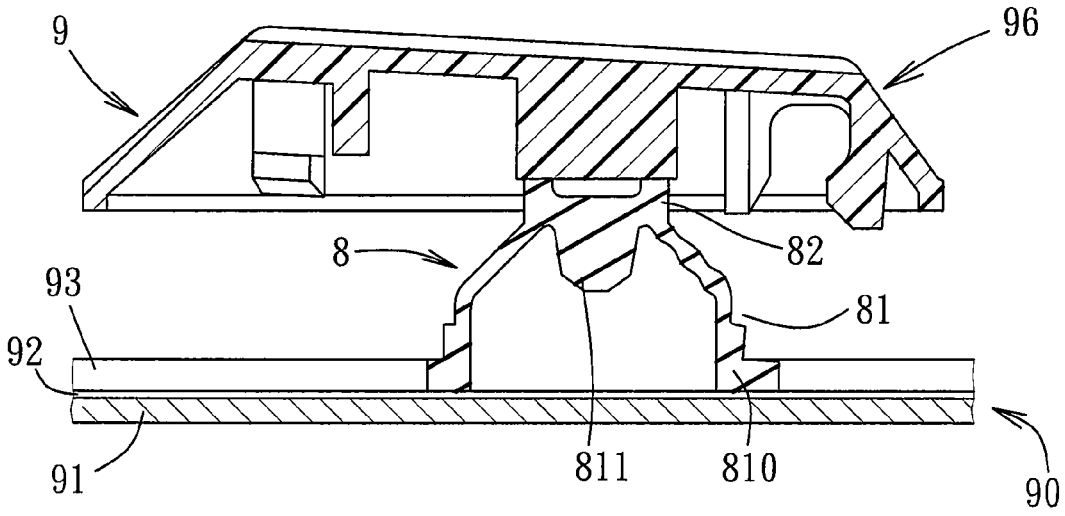
F I G. 1 PRIOR ART
FIG. 1 is a cross-sectional view of a conventional press key.
Figure 2:
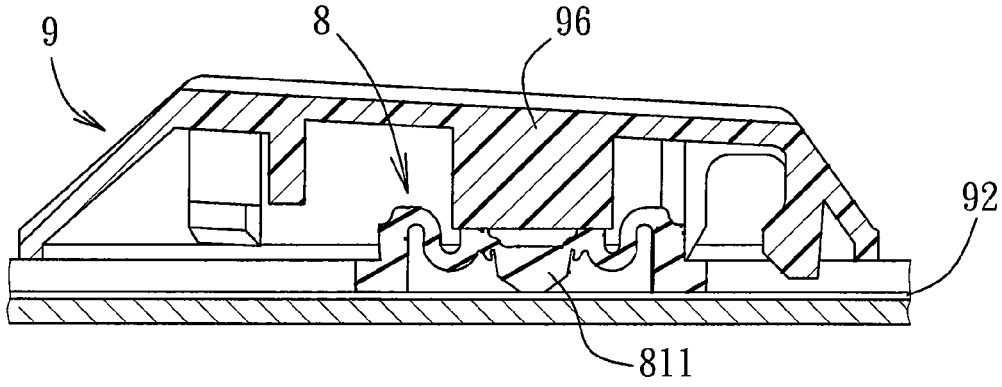
F I G. 2 PRIOR ART
FIG. 2 is a view illustrating the press key of FIG. 1 in a pressed state.

Before the present invention is described in greater detail with reference to the accompanying preferred embodiments, it should be noted herein that like elements are denoted by the same reference numerals throughout the disclosure.

Figure 3:
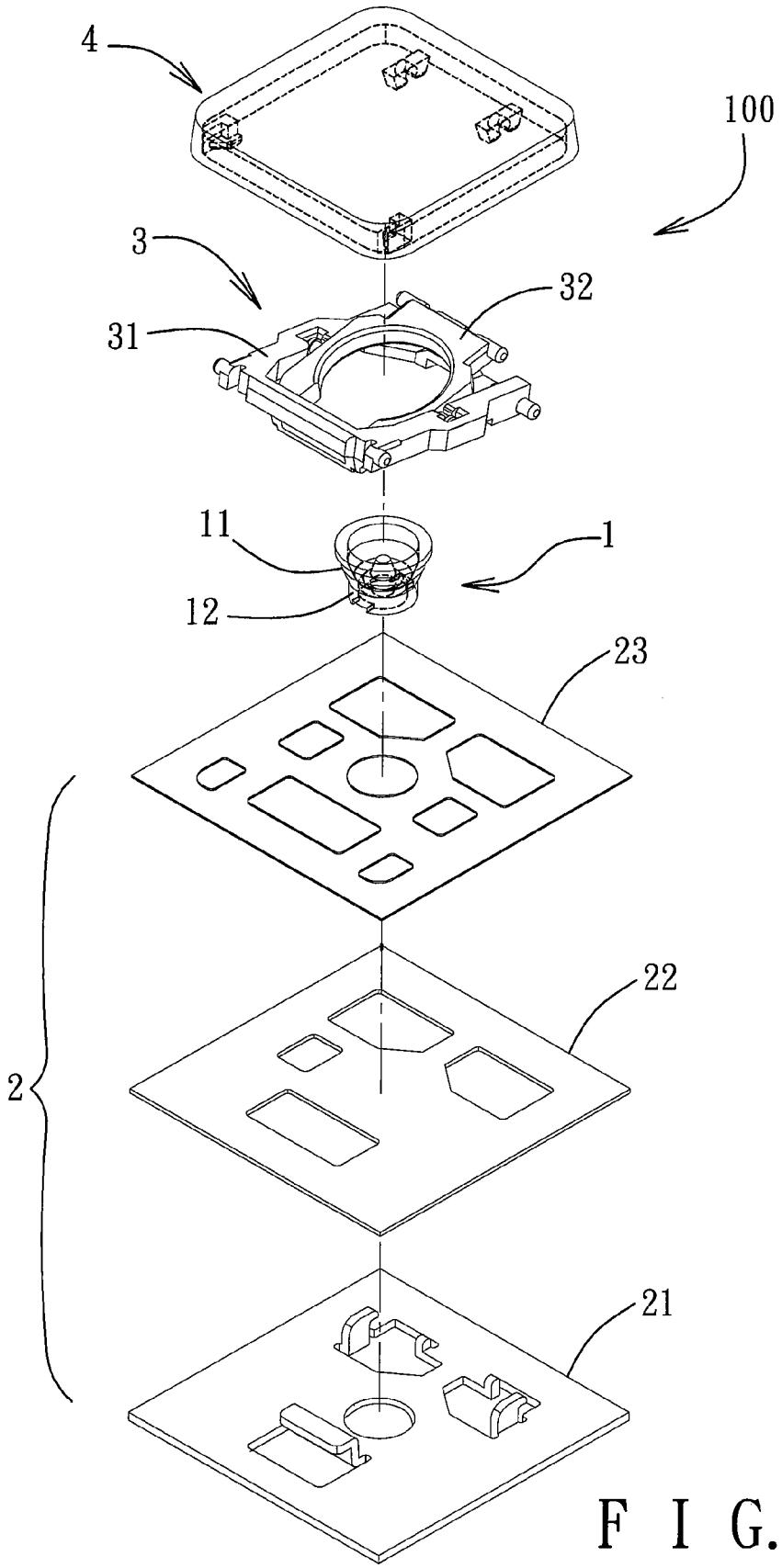
FIG. 3 is an exploded perspective view of the first preferred embodiment of a press key according to this invention.

Referring to FIG. 3, the first preferred embodiment of a press key 100 according to this invention comprises an elastic member 1, a circuit module 2, a scissors type-linkage assembly 3, and a keycap 4.

The keycap 4 is disposed above the circuit module 2. The scissors type-linkage assembly 3 is movably connected between the keycap 4 and the circuit module 2, and is disposed around the elastic member 1. The scissors type-linkage assembly 3 includes first and second levers 31, 32 that are connected pivotally to each other. Since the scissors type-linkage assembly 3 is well-known in the relevant art, a detailed description thereof is omitted for the sake of brevity.

Figure 4:
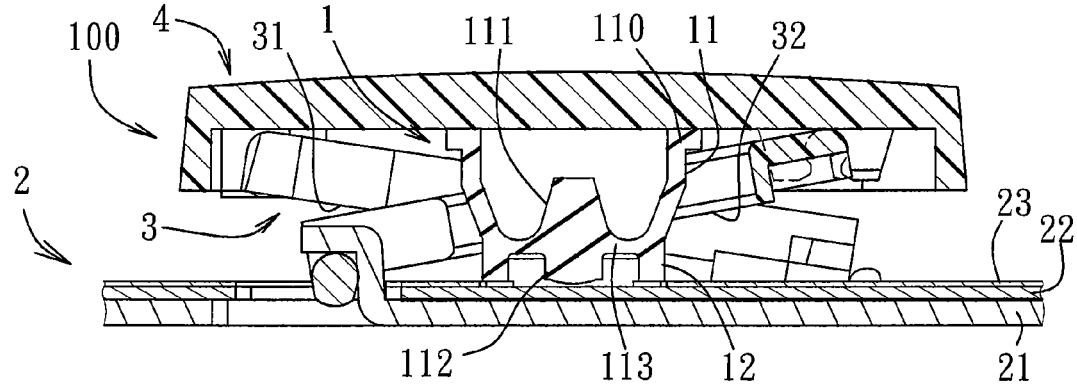
FIG. 4 is a cross-sectional view of the press key of FIG. 3 in an assembled state.

Referring to FIG. 4, the elastic member 1 is disposed between the circuit module 2 and the keycap 4, and includes a bowl portion 11 and a leg portion 12. The bowl portion 11 has a width larger than that of the leg portion 12 and includes a top open end 110, a first contact 111, a second contact 112, and a bottom wall 113. The top open end 110 faces the keycap 4. The bottom wall 113 is disposed opposite to the top open end 110. The first contact 111 extends upwardly from the bottom wall 113 to contact the keycap 4 when the keycap 4 is pressed. The second contact 112 extends downwardly from the bottom wall 113 to contact the circuit module 2 when the keycap 4 is pressed. The leg portion 12 extends downwardly from the bottom wall 113 and surrounds the second contact 112.

The elastic member 1 is used to support the keycap 4 and to space the circuit module 2 apart from the keycap 4. The bowl portion 11 has a depth larger than a height of the leg portion 12. The first contact 111 has a height that is measured from the bottom wall 113 to a top end of the first contact 111, and that is larger than a height of the second contact 112 that is measured from the bottom wall 113 to a bottom end of the second contact 112.

In this embodiment, the circuit module 2 includes, from bottom to top, a supporting board 21 made of metal, a circuit board 22, and an insulating layer 23 made of a mylar film. In the first preferred embodiment, the circuit board 22 is disposed on the supporting board 21.

Figure 5:
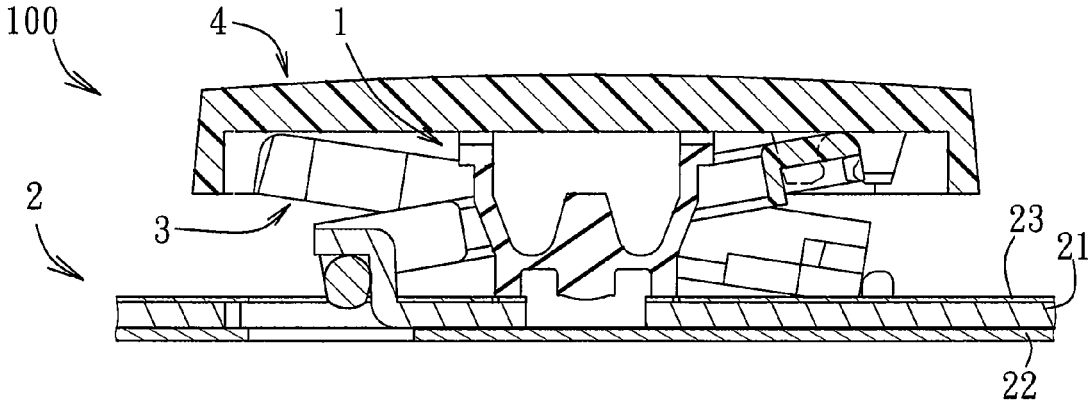
FIG. 5 is a cross-sectional view of the second preferred embodiment of a press key according to this invention.

FIG. 5 illustrates the second preferred embodiment of a press key 100 according to the present invention. The second preferred embodiment differs from the first preferred embodiment in that the circuit module 2 includes, from bottom to top, the circuit board 22, the supporting board 21, and the insulating layer 23. In the second preferred embodiment, the circuit board 22 is disposed below the supporting board 21.

Figure 6:
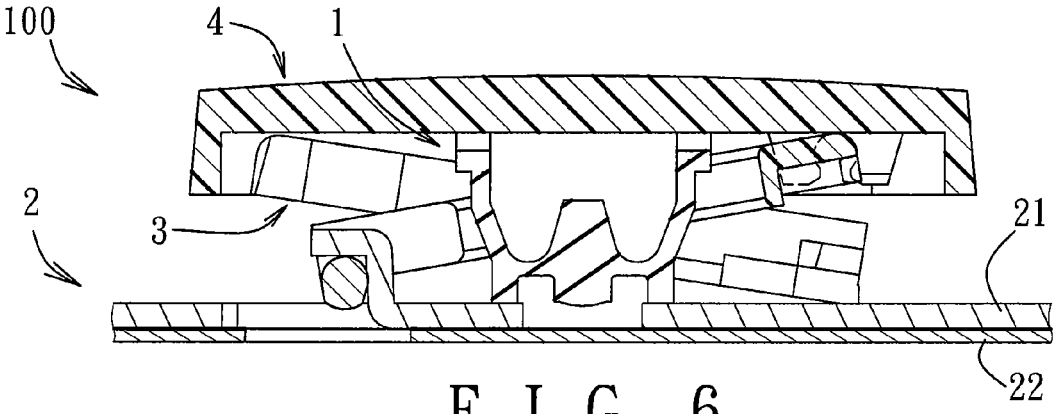
FIG. 6 is a cross-sectional view of the third preferred embodiment of a press key according to this invention.

FIG. 6 illustrates the third preferred embodiment of a press key 100 according to the present invention. The third preferred embodiment differs from the second preferred embodiment in that the circuit module 2 does not include the insulating layer 23.

Because the bowl portion 11 of the elastic member 1 supports and contacts a relatively large area of the keycap 4, compared to the prior art shown in FIG. 1, the keycap 4 has good resiliency and compressibility even at corners thereof. In addition, because the elastic member 1 has the first and second contacts 111, 112, the keycap 4 can be pressed smoothly.

Figure 7:
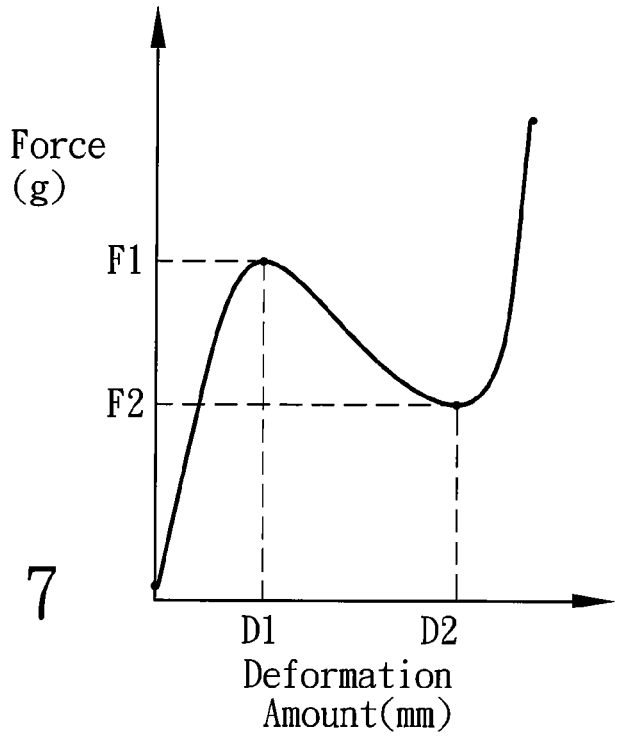
FIG. 7 shows a plot illustrating the relationship between a force acting on a top face of the keycap according to this invention and a deformation amount of the elastic member according to this invention.
Figure 8:
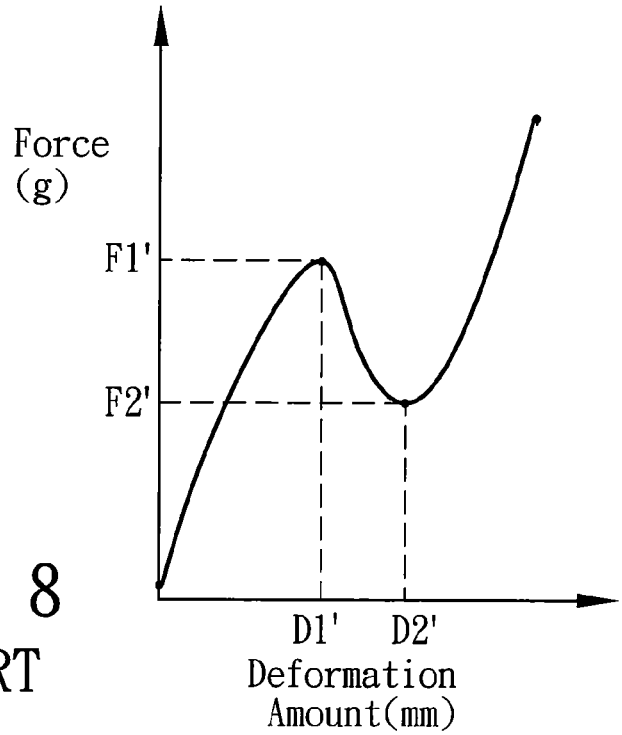
F I G. 8 PRIOR ART
FIG. 8 shows a plot illustrating the relationship between a force acting on a top face of a conventional keycap and a deformation amount of a conventional elastic member.

Referring to FIG. 7, when a force applied to a top face of the keycap 4 reaches a sufficient amount F1, a deformation amount of the elastic member 1 is D1. When the applied force decreases to F2 from F1, the deformation amount reaches D2. Referring to FIG. 8, when the force applied to the conventional press key 9 (FIG. 1) reaches F1', the deformation amount of the elastic member 8 is D1'. When the force decreases from F1' to F2', the deformation amount of the elastic member 8 is D2'. Because the difference value (D2−D1) in the press key 100 of the present invention is larger than the difference value (D2'−D1') in the conventional press key 9, an effective stroke achieved using the elastic member 1 in the present invention is larger than that achieved by the elastic member 8 of the conventional press key 9. Accordingly, the press key 100 of the present invention is more comfortable to operate than the conventional press key 9.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A press key, comprising:

a circuit module;

a keycap disposed above said circuit module; and an elastic member disposed between said circuit module and said keycap, and including a bowl portion and a leg portion, said bowl portion having a width larger than that of said leg portion and including a top open end facing said keycap, a bottom wall opposite to said top open end, a first contact extending upwardly from said bottom wall to contact said keycap when said keycap is pressed, and a second contact extending downwardly from said bottom wall to contact said circuit module when said keycap is pressed, said leg portion extending downwardly from said bottom wall and surrounding said second contact.

2. The press key of claim 1, wherein said bowl portion has a depth larger than a height of said leg portion.

3. The press key of claim 1, wherein said first contact has a height that is measured from said bottom wall to a top end of said first contact, and that is larger than a height of said second contact that is measured from said bottom wall to a bottom end of said second contact.

4. The press key of claim 1, further comprising a scissors type-linkage assembly movably connected between said keycap and said circuit module, and disposed around said elastic member.

5. The press key of claim 1, wherein said circuit module includes, from bottom to top, a supporting board, a circuit board, and an insulating layer.

6. The press key of claim 1, wherein said circuit module includes, from bottom to top, a circuit board, a supporting board, and an insulating layer.

7. The press key of claim 1, wherein said circuit module includes, from bottom to top, a circuit board and a supporting board.

* * * * *